US012342889B2

(12) United States Patent
Yip et al.

(10) Patent No.: US 12,342,889 B2
(45) Date of Patent: Jul. 1, 2025

(54) GARMENT WITH ACCESSIBLE MAGNETIC CLOSURE

(71) Applicant: Mast Industries (Far East) Limited, Kowloon (HK)

(72) Inventors: Suet Hing Yip, Festival (HK); Chi Wing Leslie Lin, Kowloon (HK); Kristen Malarky, Brooklyn, NY (US); Allison Mendoza, Brooklyn, NY (US)

(73) Assignee: Mast Industries (Far East) Limited, Kowloon Bay (HK)

( * ) Notice: Subject to any disclaimer, the term of this patent is extended or adjusted under 35 U.S.C. 154(b) by 0 days.

(21) Appl. No.: 18/469,728

(22) Filed: Sep. 19, 2023

(65) Prior Publication Data

US 2024/0090605 A1 Mar. 21, 2024

Related U.S. Application Data

(60) Provisional application No. 63/376,512, filed on Sep. 21, 2022.

(51) Int. Cl.
*A41F 1/00* (2006.01)

(52) U.S. Cl.
CPC ..... *A41F 1/002* (2013.01); *A41F 1/006* (2013.01)

(58) Field of Classification Search
CPC ..... A41F 1/002; A41F 1/006
See application file for complete search history.

(56) References Cited

U.S. PATENT DOCUMENTS

| | | | |
|---|---|---|---|
| 4,145,763 | A | 3/1979 | Abrams et al. |
| 4,399,595 | A | 8/1983 | Yoon et al. |
| 6,247,184 | B1 | 6/2001 | Watts |
| 6,378,174 | B1 | 4/2002 | Wong |
| 6,560,786 | B2 | 5/2003 | Lipton |
| 6,606,767 | B2 | 8/2003 | Wong |
| 6,622,349 | B2 | 9/2003 | Wong |
| D585,182 | S | 1/2009 | Hodges et al. |
| 7,707,698 | B2 | 5/2010 | Gardner |
| D623,987 | S | 9/2010 | Fildan et al. |
| 8,186,025 | B2 | 5/2012 | Fildan et al. |
| 8,230,559 | B2 | 7/2012 | Fildan et al. |
| D677,447 | S | 3/2013 | Shoemaker |
| 8,460,054 | B2 | 6/2013 | Swendseid |

(Continued)

FOREIGN PATENT DOCUMENTS

| | | | |
|---|---|---|---|
| AU | 2019101023 | A4 | 10/2019 |
| AU | 2019101479 | A4 | 1/2020 |

(Continued)

*Primary Examiner* — David M Upchurch
(74) *Attorney, Agent, or Firm* — Andrus Intellectual Property Law, LLP

(57) ABSTRACT

A magnetic hook-type closure for a garment has male and female coupling elements and first and second magnets having a first and a second polarity, respectively. The male coupling element includes the first magnet and a hook having a sloped arm and the female coupling element has the second magnet and a recess having a sloped end. The first and second magnets are configured to pull the male coupling element and the female coupling element towards one another and the sloped arm of the hook is configured to engage with the sloped end of the recess to guide the male coupling element into engagement with the female coupling element.

16 Claims, 7 Drawing Sheets

(56) References Cited

U.S. PATENT DOCUMENTS

| | | | | |
|---|---|---|---|---|
| 8,505,174 | B2 | 8/2013 | Fildan et al. | |
| 8,516,665 | B2 | 8/2013 | Clarke et al. | |
| D703,095 | S | 4/2014 | Fildan et al. | |
| 8,745,829 | B2 | 6/2014 | Wanzenboeck et al. | |
| 8,869,358 | B2 | 10/2014 | Wanzenboeck et al. | |
| 8,935,835 | B2 | 1/2015 | Fildan et al. | |
| 9,049,894 | B2 | 6/2015 | Wong | |
| D768,958 | S | 10/2016 | Dickson | |
| D782,155 | S | 3/2017 | Koppuzhayil et al. | |
| D782,158 | S | 3/2017 | Shoemaker et al. | |
| 9,642,407 | B2 | 5/2017 | Fildan et al. | |
| 9,700,082 | B2 | 7/2017 | Tempesta | |
| 9,756,906 | B1 | 9/2017 | Fink | |
| 9,918,500 | B2 | 3/2018 | Tempesta | |
| 10,231,519 | B2 | 3/2019 | Fildan et al. | |
| D844,933 | S | 4/2019 | Mohammadian | |
| 10,362,837 | B1 | 7/2019 | Fink | |
| 10,362,838 | B2 | 7/2019 | Fildan et al. | |
| 10,499,698 | B2 | 12/2019 | Fildan et al. | |
| 10,681,962 | B1 | 6/2020 | Fildan et al. | |
| 10,701,998 | B2 | 7/2020 | Fildan et al. | |
| 11,478,050 | B2 * | 10/2022 | Fiedler | A44B 11/258 |
| 11,571,033 | B2 * | 2/2023 | Fiedler | A45C 13/1069 |
| 2004/0128742 | A1 | 7/2004 | Jackson | |
| 2006/0021115 | A1 | 2/2006 | Stanley | |
| 2009/0204088 | A1 | 8/2009 | Stearman et al. | |
| 2012/0021669 | A1 | 1/2012 | Johnstone | |
| 2012/0046634 | A1 | 2/2012 | Shields | |
| 2012/0054946 | A1 | 3/2012 | Griffith et al. | |
| 2012/0324632 | A1 | 12/2012 | Hurvitz | |
| 2013/0291287 | A1 | 11/2013 | Shoemaker | |
| 2014/0215692 | A1 | 8/2014 | Mohammadian | |
| 2016/0113329 | A1 | 4/2016 | Baker | |
| 2017/0135429 | A1 | 5/2017 | Fildan et al. | |
| 2018/0146730 | A1 | 5/2018 | Fildan et al. | |
| 2018/0360147 | A1 * | 12/2018 | Fiedler | A45C 13/1069 |
| 2019/0166920 | A1 | 6/2019 | Savoy et al. | |
| 2019/0261712 | A1 * | 8/2019 | Zimmermann | A44B 18/0007 |
| 2019/0343239 | A1 * | 11/2019 | Fiedler | A44B 11/258 |
| 2020/0029629 | A1 | 1/2020 | Jarvis | |
| 2020/0154804 | A1 * | 5/2020 | Huang | A44B 11/28 |
| 2020/0260803 | A1 | 8/2020 | Whittaker | |
| 2021/0186121 | A1 | 6/2021 | Denning | |
| 2021/0219627 | A1 | 7/2021 | Brizay | |
| 2022/0000202 | A1 | 1/2022 | Lin | |

FOREIGN PATENT DOCUMENTS

| | | | |
|---|---|---|---|
| AU | 2021102590 | A4 | 7/2021 |
| CN | 108741243 | A | 11/2018 |
| DE | 29923027 | U1 | 12/2000 |
| EP | 1166663 | A1 | 1/2002 |
| EP | 1264553 | A1 | 12/2002 |
| EP | 2337465 | B1 | 12/2012 |
| GB | 2506646 | A | 4/2014 |
| GB | 2530582 | A | 3/2016 |
| GB | 2582381 | B | 4/2021 |
| HK | 1258740 | A | 11/2019 |
| KR | 10-1919405 | B1 | 11/2018 |
| KR | 10-1981306 | B1 | 5/2019 |
| WO | 2010111754 | A1 | 10/2010 |

* cited by examiner

GARMENT WITH ACCESSIBLE MAGNETIC CLOSURE

CROSS-REFERENCE TO RELATED APPLICATION

The present application claims the benefit of U.S. Provisional Application No. 63/376,512, filed Sep. 21, 2022, which is hereby incorporated by reference herein.

FIELD

The present disclosure generally relates to garments having modifications made for improved accessibility.

BACKGROUND

The following U.S. Patents and Applications provide background information.

U.S. Pat. No. 8,230,559 discloses a fastener for securing together two garment strap ends having confronting faces and having at least male elements mounted on the face of one of the strap ends and respective female elements mounted on the face of the other strap end, generally complementary to the male element, and, with the faces touching or closely juxtaposed, slidably engageable in a direction parallel to the faces with the male elements to fasten the two strap ends together. Respective male and female magnets on the strap ends are oriented so as to hold the strap ends in a finder position with the faces engaging or closely juxtaposed with each other and the male and female elements spaced in the direction and disengaged from each other so that displacement of the strap ends apart in the direction from the finder position will engage and lock together the male and female elements.

U.S. Pat. No. 9,049,894 discloses a magnetic strap fastener for use with existing strapped articles without modification. The fastener includes first and second fastener parts for attaching to a complementary engagement arrangement on first and second strap ends. The first and second fastener parts are detachably engageable with each other by magnetic coupling or attraction and include complementary engagement devices for detachable engagement with the corresponding complementary engagement arrangement on the strap ends. Such a fastener is advantageous because it offers the benefits of magnetic fasteners and is at the same time readily attachable to an article having strap ends with an existing pair of complementary engagement devices.

U.S. Patent Application Publication No. 2018/0146730 discloses a hook and eye fastener for securing two straps of an item of clothing such as a brassiere together. The hook part is a substantially flat body mounted on the face of one strap and the eye part is a substantially flat frame mounted on the face of the other strap. The hook part comprises an arm extending outwardly therefrom and the frame defines an open mouth dimensioned to receive the arm of the hook part. The hook part and the eye part are configured to provide a fastener having a thickness of between 4 mm and 5 mm in total and that is relatively simple to engage and positively disengage.

U.S. Pat. No. 10,701,998 discloses a fastener for clothing or lingerie. The fastener comprises a front element having at least one seat cavity and a back element having at least one bump for location in the seat cavity. The front element and back element each comprise magnets to assist in the location of the bump in the seat cavity. The front and back elements additionally comprise a plurality of complementary catch faces which secure the engagement of the front and back elements and are operable to prevent inadvertent release of the back element from the front element when the back element is subjected to forces in any of a plurality of disparate directions.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example according to the present disclosure generally relates to a magnetic hook-type closure for a garment comprising male and female coupling elements and first and second magnets having a first and a second polarity, respectively. The male coupling element comprises the first magnet and a hook having a sloped arm and the female coupling element comprises the second magnet and a recess having a sloped end. The first and second magnets are configured to pull the male coupling element and the female coupling element towards one another and the sloped arm of the hook is configured to engage with the sloped end of the recess to guide the male coupling element into engagement with the female coupling element.

According to one aspect, each of the male and female coupling elements comprises a central body and an outer flange about the central body.

According to further aspects, the closure further comprises first and second layers of material, wherein the first and second layers of material are sealed around the outer flange of the female coupling element and attached to a first end of a garment. Optionally, one of the first and second layers of material has an opening configured to receive the central body of the female coupling element.

According to further aspects, the closure further comprises third and fourth layers of material, wherein the third and fourth layers of material are sealed around the outer flange of the male coupling element and attached to a second end of the garment. Optionally, one of the third and fourth layers of material has an opening configured to receive the central body of the male coupling element.

According to further aspects, each of the central bodies of the male and female coupling elements comprises a depression configured to hold the first or second magnet, respectively, such that an outer surface of the first or second magnet lies flush with an outer surface of the respective central body.

According to one aspect, the female coupling element further comprises a lip at an end of the recess opposite the sloped end, the lip being configured to engage the hook of the male coupling element. Optionally, the lip is sloped parallel to the sloped end of the recess.

Another example according to the present disclosure generally relates to a closure for a garment. The closure comprises a first closure portion including a first body, a first magnet situated within the first body, and a recess formed in the first body adjacent the first magnet. The closure includes a second closure portion including a second body, a second magnet situated within the second body, and a hook protruding from the second body adjacent the second magnet. The recess extends from a first opening at a first surface of the first body toward a second opening at an opposite second surface of the first body, and the recess is angled such that the first opening is located further from the first magnet than the second opening with respect to a longitudinal direction of the first closure portion. The hook extends from a first end at a first surface of the second body toward a free second end, and the hook is curved from the first end to the second end toward the second magnet. The first and second closure portions are configured such that attraction between the first and second magnets aligns the first and second magnets with one another and simultaneously causes the hook to be received within the recess.

According to one aspect, the first closure portion comprises a first strip of material to which the first body is attached, and the first body is oriented on the first strip of material such that the first magnet is located between the recess and a free end of the first strip of material. The second closure portion comprises a second strip of material to which the second body is attached, and the second body is oriented on the second strip of material such that the hook is located between the second magnet and a free end of the second strip of material.

According to further aspects, the end of the first strip of material that is opposite the free end thereof is configured to be connected to a first portion of a garment. The end of the second strip of material that is opposite the free end thereof is configured to be connected to a second portion of the garment. The first and second portions of the garment are configured to be coupled to one another via the first and second closure portions.

According to further aspects, at least one of the first and second bodies comprises a depression configured to hold the respective first or second magnet such that an outer surface of the respective first or second magnet lies flush with an outer surface of the at least one of the first and second bodies.

According to one aspect, the recess forms a lip configured to engage the hook.

Another example according to the present disclosure generally relates to a closure for a garment, the closure comprising a first closure portion comprising a female coupling element and a second closure portion comprising a first male coupling element and a second male coupling element. The closure includes a first magnet having a first polarity, a second magnet having a second polarity, and a third magnet having the second polarity. The female coupling element comprises the first magnet and a recess having a sloped end. The first male coupling element comprises the second magnet and a first hook having a first sloped arm. The second male coupling element comprises the third magnet and a second hook having a second sloped arm. The first male coupling element is positioned at a first location on the second closure portion and the second male coupling element is positioned at a second location on the second closure portion that is spaced from the first location. The second and third magnets of the respective first and second male coupling elements are magnetically attracted to the first magnet of the female coupling element. One of the first and second sloped arms of a respective one of the first and second hooks is configured to engage with the sloped end of the recess so as to couple the first and second closure portions together.

According to one aspect, each of the male and female coupling elements comprises a central body and an outer flange about the central body.

According to further aspects, the closure further comprises first and second layers of material, wherein the first and second layers of material are sealed around the outer flange of the female coupling element and are configured to be attached to a garment.

According to further aspects, the closure further comprises third and fourth layers of material, wherein the third and fourth layers of material are sealed around the outer flanges of the first and second male coupling elements and are configured to be attached to the garment.

According to further aspects, a garment comprises a front portion, a rear portion, and the closure. The first and second layers of material are attached to a rear flap of the rear portion, and the third and fourth layers of material are attached to a front flap of the front portion.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
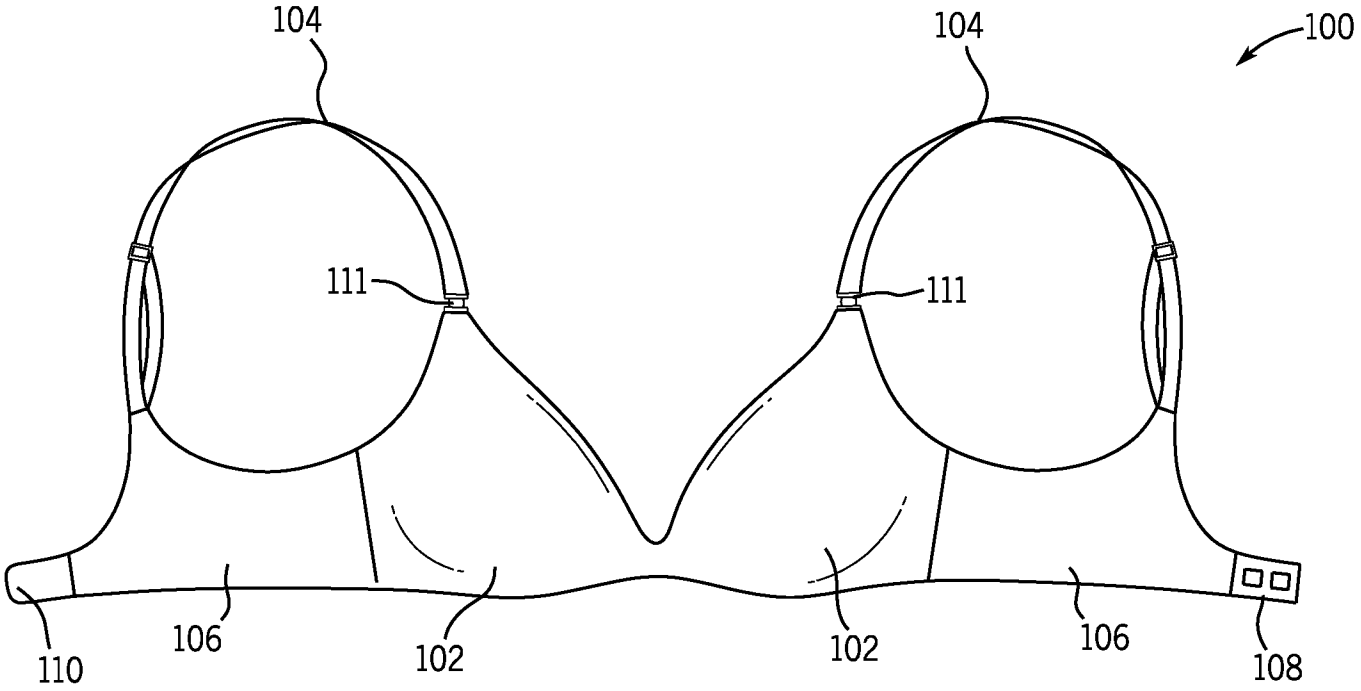
FIG. 1 illustrates a front view of an example of a bra according to the present disclosure.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another. Unless otherwise specified or limited, the word "about" means±10%. The phrase "at least about" means greater than or equal to the value recited ±10%.

The present application relates to garments, such as bras or panties, which have closures for connecting two ends of the garment. The present application relates to garments which are configured to be accessible for users who have difficulty operating typical closures, such as hook-and-eye closures, snaps, buttons, or other closures that require two hands or unimpaired dexterity. The garments can be any shape and style, which details are not limiting on the scope of the present disclosure.

FIG. 1 shows a front view of one example of a generic bra including closures according to the present disclosure. Here the bra 100 has two cups 102 and two shoulder straps 104 connected to respective upper edges of the cups 102 by way of two strap converters 111. The rear ends of each shoulder strap 104 are connected to wings 106, which wings 106 are attached to the outer edges of the cups 102 and are configured to encircle the wearer's torso. The wings 106 are connected in the back of the bra 100 by way of a closure, as is conventional. The present application relates to a closure that can be used, for example, to attach the two frees ends of the wings 106. A first closure portion of the closure is shown at 108 and a second closure portion of the closure is shown at 110.

Figure 2:
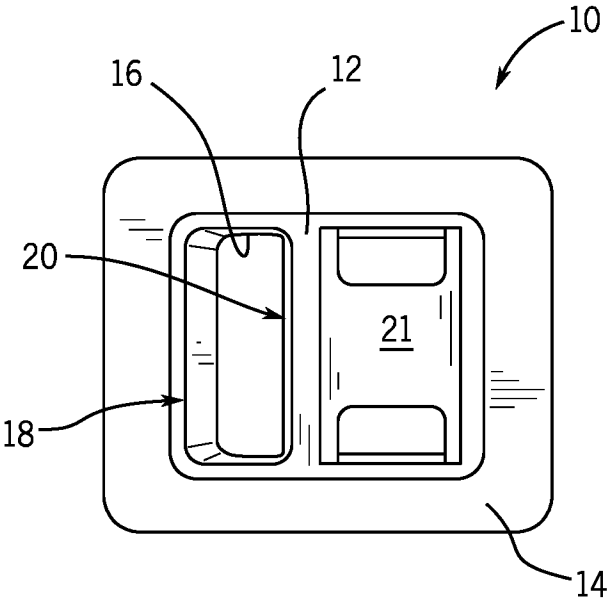
FIG. 2 illustrates a plan view of a female coupling element for the bra.
Figure 8:
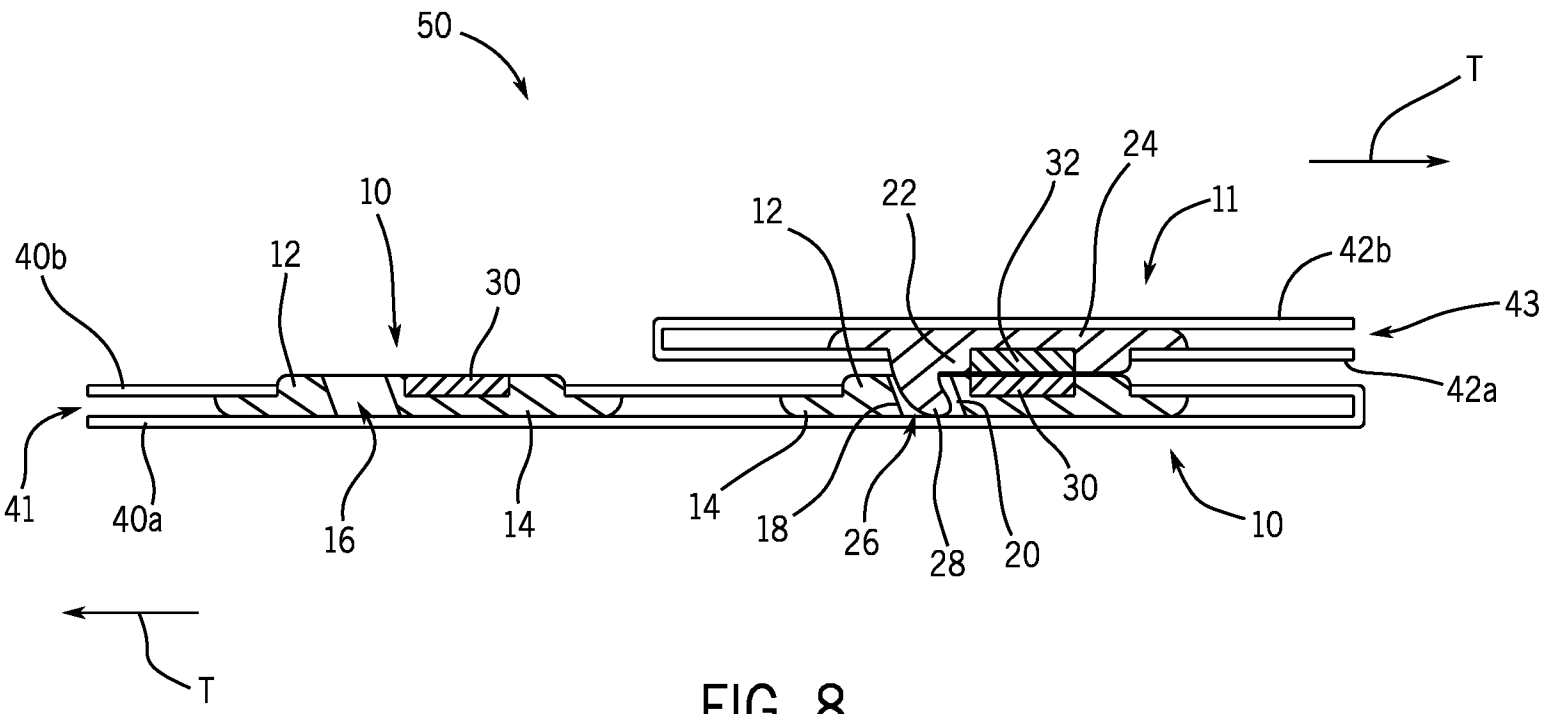
FIG. 8 illustrates a sectional view of the male coupling element while engaged with the female coupling element.

FIG. 2 shows a female coupling element 10 of the present disclosure, which can be provided on the first closure portion 108 of the closure of the bra 100 of FIG. 1. The female coupling element 10 is substantially rectangular, having a central body 12 and an outer flange 14 which extends about the perimeter of the central body 12 to facilitate attachment of the female coupling element 10 to material such as fabric for attachment of the female coupling element 10 to a garment. The female coupling element 10 includes a recess 16 within the central body 12, the recess 16 having a sloped end 18 and a lip 20 at an end of the recess 16 opposite the sloped end 18. In the present example, the lip 20 is sloped parallel to the sloped end 18 of the recess 16, but the two surfaces could be sloped at different angles. The sloped end 18 is positioned proximate the perimeter of the central body 12 and the lip 20 is positioned near the center of the central body 12. A first magnet 30 (see FIGS. 5 and 8) of a first polarity is positioned within the central body 12 of the female coupling element 10 adjacent the lip 20 of the recess 16. The first magnet 30 is received in an appropriately sized and shaped depression 21 in the central body 12 of the female coupling element 10 and can be held there by press fit and/or adhesive. The depression 21 is configured (perimeter-wise and depth-wise) to hold the first magnet 30 such that an outer surface of the first magnet 30 lies flush with an outer surface of the central body 12, as shown in FIG. 8. This way, the first magnet 30 does not physically interfere with the action of coupling the female and male coupling elements 10, 11 together, as will be described further herein below.

Figure 3:
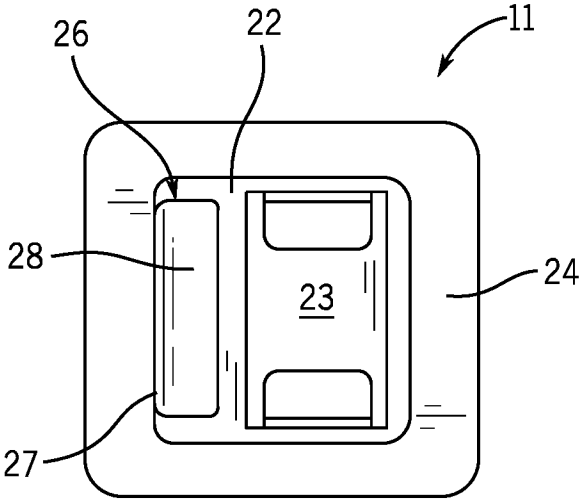
FIG. 3 illustrates a plan view of a male coupling element for the bra.

FIG. 3 shows the male coupling element 11 of the present disclosure, which can be provided on the second closure portion 110 of the closure of the bra 100. The male coupling element 11 is substantially rectangular, having a central body 22 and an outer flange 24 which extends about the perimeter of the central body 22 to facilitate attachment of the male coupling element 11 to material such as fabric for attachment of the male coupling element 11 to a garment. The male coupling element 11 includes a hook 26 positioned at one end of the central body 22 and having a sloped arm 28. The base 27 of the hook 26 is positioned proximate the perimeter of the central body 22, and the sloped arm 28 extends toward the center of the central body 22. A second magnet 32 (see FIGS. 6 and 8) of a second polarity is positioned within the central body 22 of the male coupling element 11 near the center of the central body 22. The second magnet 32 is received in an appropriately sized and shaped depression 23 in the central body 22 of the male coupling element 11 and can be held there by press fit and/or adhesive. The depression 23 is configured (perimeter-wise and depth-wise) to hold the second magnet 32 such that an outer surface of the second magnet 32 lies flush with an outer surface of the central body 22, as shown in FIG. 8. This way, the second magnet 32 does not physically interfere with the action of coupling the female and male coupling elements 10, 11 together, as will be described further herein below.

Figure 4:
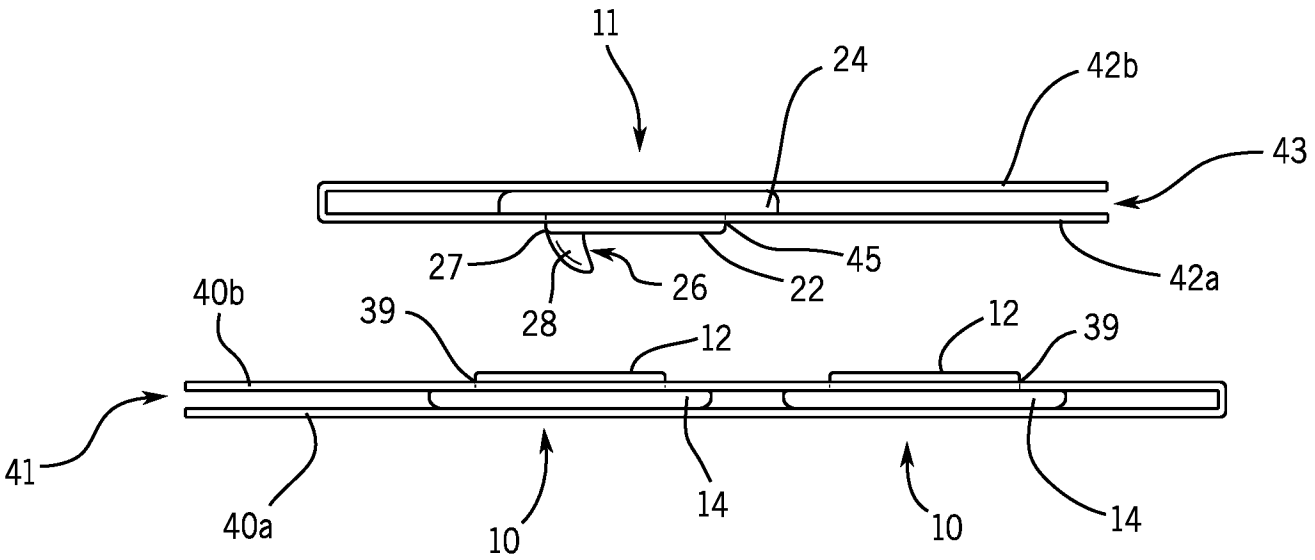
FIG. 4 illustrates a sectional view of the male and female coupling elements in an unengaged state.
Figure 5:
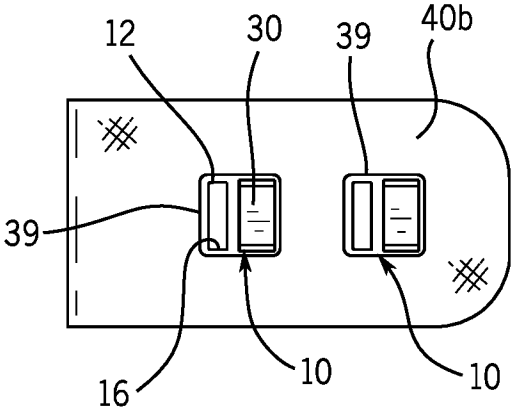
FIG. 5 illustrates a plan view of the female coupling element sealed between two layers of fabric to form a first closure portion.

FIGS. 4 and 5 show the female coupling element 10 having first and second layers 40*a*, 40*b* of material (e.g., fabric) sealed onto opposing faces of the outer flange 14. The first layer 40*a* is continuous, such that the female coupling element 10 is concealed on that side. The second layer 40*b* has an opening 39 configured to receive the central body 12 of the female coupling element 10. The opening 39 is sized such that the central body 12 of the female coupling element 10 is exposed, but the outer flange 14 is concealed by the material of the second layer 40*b*. In the exemplary embodiment, the first layer 40*a* and the second layer 40*b* are coupled to one another and attached to a first end of a garment, such as a bra or panty. The first and second layers 40*a*, 40*b* can be bonded to the outer flange 14 of the female coupling element 10 by way of, for example, adhesive and/or ultrasonic welding. The first and second layers 40*a*, 40*b* can be bonded to each other around the outer flange 14 (i.e., on the interior faces of the first and second layers 40*a*, 40*b*), except at an end 41 of the first and second layers 40*a*, 40*b* where they are left unattached. At the unattached end 41, the first and second layers 40*a*, 40*b* can be folded around the end of a garment and attached thereto by way of bonding or stitching. Although not shown herein, a covering layer can be provided over the first layer 40*a*, to provide a smooth inner face configured to lie against a wearer's skin. The materials of each of the first and second layers 40*a*, 40*b* can be fabric pre-laminated to an adhesive, with the adhesive sides facing each other. The edges of the first and second layers 40*a*, 40*b* can be raw cut using ultrasonic cutting techniques.

Figure 6:
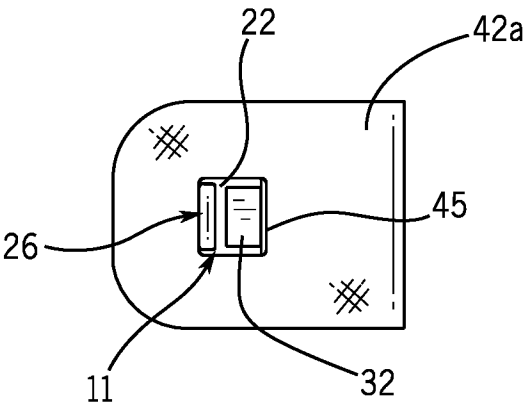
FIG. 6 illustrates a plan view of the male coupling element sealed between two layers of fabric to form a second closure portion.

FIGS. 4 and 6 show the male coupling element 11 having third and fourth layers 42*a*, 42*b* of material (e.g., fabric) sealed onto opposing faces of the outer flange 24. The third layer 42*a* has an opening 45 configured to receive the central body 22 of the male coupling element 11. The opening 45 is sized such that the central body 22 of the male coupling element 11 is exposed, but the outer flange 24 is concealed by the material of the third layer 42*a*. The fourth layer 42*b* is continuous such that the male coupling element 11 is concealed on that side. In the exemplary embodiment, the third layer 42*a* and the fourth layer 42*b* are coupled to one another and attached to a second end of the garment, opposite the end of the garment to which the first and second layers 40*a*, 40*b* and the female coupling element 10 are attached. The third and fourth layers 42*a*, 42*b* can be bonded to the outer flange 24 of the male coupling element 11 by way of, for example, adhesive and/or ultrasonic welding. The third and fourth layers 42*a*, 42*b* can be bonded to each other around the outer flange 24 (i.e., on the interior faces of the third and fourth layers 42*a*, 42*b*), except at an end 43 of the third and fourth layers 42*a*, 42*b* where they are left unattached. At the unattached end 43, the third and fourth layers 42*a*, 42*b* can be folded around the end of a garment and attached thereto by way of bonding or stitching. Although not shown herein, a covering layer can be provided over the fourth layer 42*b*, to provide a smooth face configured to face outwardly from the garment. The materials of each of the third and fourth layers 42*a*, 42*b* can be fabric pre-laminated to an adhesive, with the adhesive sides facing each other. The edges of the third and fourth layers 42*a*, 42*b* can be raw cut using ultrasonic cutting techniques.

In another example, the layers 40*a*, 40*b*, 42*a*, 42*b* are integral with the inner and outer layers of fabric of the bra or panty to which the female and male coupling elements 10, 11 are to be attached. In still other examples, the covering layers adjacent the first layer 40*a* and the fourth layer 42*b* are integral with the fabric of the bra or panty to which the female and male coupling elements 10, 11 are to be attached.

Figure 7:
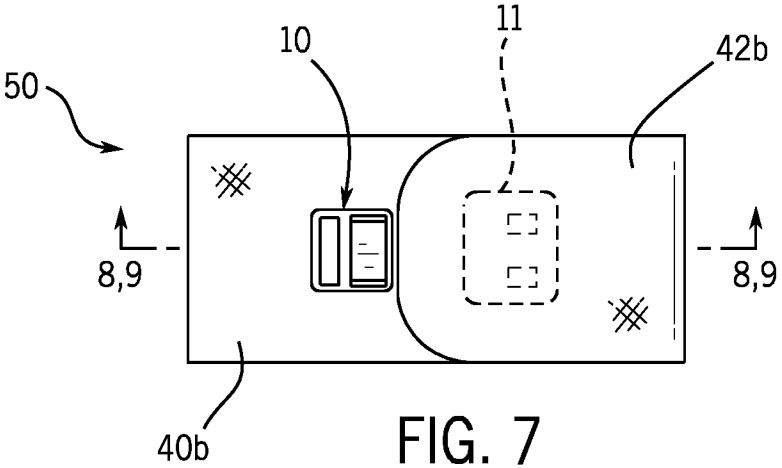
FIG. 7 illustrates a plan view of the male coupling element while engaged with the female coupling element.

FIGS. 7 and 8 show the female coupling element 10 and the male coupling element 11 engaged with one another to form a closure 50. In such an engagement, the second layer 40*b*, which is sealed to the female coupling element 10, is adjacent to (and in some examples abuts) the third layer 42*a*, which is sealed to the male coupling element 11.

In use, to couple the opposing ends of the garment together, a user brings the male coupling element 11 into proximity with the female coupling element 10. The first magnet 30 and the second magnet 32 pull the male coupling element 11 toward the female coupling element 10 such that the hook 26 comes into contact with the central body 12 of the female coupling element 10. The sloped end 18 of the recess 16 guides the hook 26 (more specifically, sloped arm 28 thereof) into the recess 16, whereafter the lip 20 of the female coupling element 10 is configured to engage the hook 26 of the male coupling element 11. More specifically, once the sloped arm 28 has slid to match the depth of the recess 16, the hook 26 is latched underneath the lip 20 of the recess 16, fixing the male coupling element 11 to the female coupling element 10. Thus, a wearer who may not have full dexterity is able to connect the male coupling element 11 to the female coupling element 10 simply by bringing the two coupling elements 10, 11 into close proximity to one another. The male and female coupling elements 11, 10 are not able to be pulled apart in the direction of the arrows T (FIG. 8), showing the tension that is applied during normal use as the garment is worn. Rather, such tension T simply pulls the hook 26 further into the recess 16 and under the lip 20 thereof. On the other hand, movement of the male and female coupling elements 11, 10 opposite the directions of arrows T will overcome the attraction of the magnets 30, 32 and will unhook the male coupling element 11 from the female coupling element 10.

When referring to the polarity of the magnets 30, 32, it is understood that it is the polarity of the uncovered sides of the magnets that are referred to, which uncovered sides are located adjacent one another when the female and male coupling elements 10, 11 are coupled together. The first polarity of the first magnet 30 may be north or south, while the second polarity of the second magnet 32 is the opposite polarity (i.e., south if the first polarity is north, or north if the first polarity is south). In such an example, the entire uncovered face of the first magnet 30 may be a north pole, and the entire uncovered face of the second magnet 32 may be a south pole. In another example, the uncovered face of the first magnet 30 is north at one end and south at the other end, while the uncovered face of the second magnet 32 is south at one end (the end configured to be adjacent the north end of the first magnet 30) and north at the other end (the end configured to be adjacent the south end of the first magnet 30).

The central bodies 12, 22 and outer flanges 14, 24 of the female and male coupling elements 10, 11 are made of a non-magnetic material. For example, the non-magnetic material may be a polymer, a composite, or a non-magnetic metal. This way, the magnets 30, 32 are not attracted to other parts of the female and male coupling elements 10, 11, but only to each other, ensuring the hook 26 is correctly aligned with the recess 16 when the female and male coupling elements 10, 11 are brought in proximity to one another.

Figure 9:
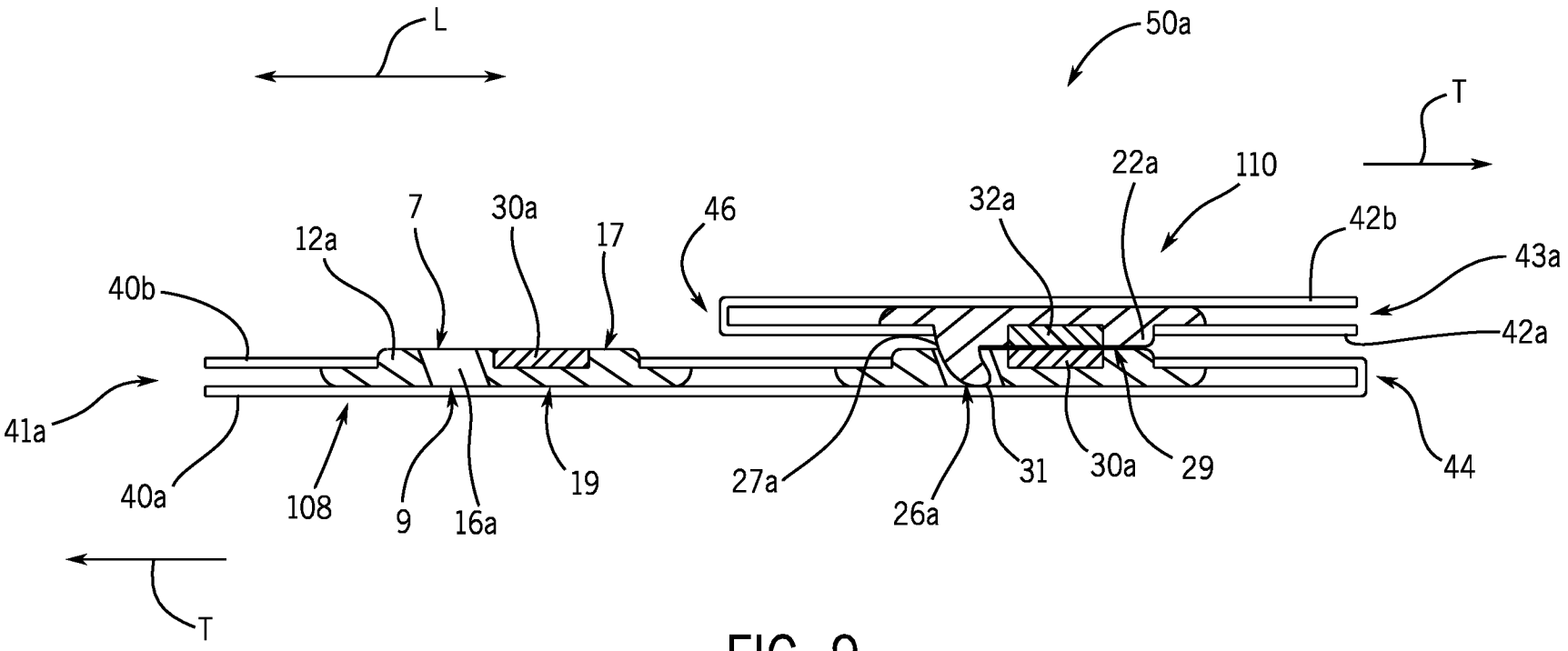
FIG. 9 illustrates a sectional view of first and second closure elements engaged with one another.

According to another example, and referring to FIG. 9, a closure 50*a* includes a first closure portion 108 having a first body 12*a*, a first magnet 30*a* situated within the first body 12*a*, and a recess 16*a* formed in the first body 12*a* adjacent the first magnet 30*a*. A second closure portion 110 includes a second body 22*a*, a second magnet 32*a* situated within the second body 22*a*, and a hook 26*a* protruding from the second body 22*a* adjacent the second magnet 32*a*. The recess 16*a* extends from a first opening 7 at a first surface 17 of the first body 12*a* toward a second opening 9 at an opposite second surface 19 of the first body 12*a*. The recess 16*a* is angled such that the first opening 7 is located further from the first magnet 30*a* than the second opening 9 with respect to a longitudinal direction L of the first closure portion 108. In other words, the near edge of the first opening 7 is further from the first magnet 30*a*, when measured in the longitudinal direction L, than is the near edge of the second opening 9. So too is the far edge of the first opening 7 further from the first magnet 30*a*, when measured in the longitudinal direction L, than is the far edge of the second opening 9. On the second closure portion 110, the hook 26*a* extends from a first end 27*a* at a first surface 29 of the second body 22*a* toward a free second end 31, and the hook 26*a* is curved from the first end 27*a* to the free second end 31 toward the second magnet 32*a*. The first and second closure portions 108, 110 are configured such that attraction between the first and second magnets 30*a*, 32*a* aligns the first and the second magnets 30*a*, 32*a* with one another and simultaneously causes the hook 26*a* to be received within the recess 16*a*.

The first closure portion 108 comprises a first strip of material 40*a* and/or 40*b* to which the first body 12*a* is attached, and the first body 12*a* is oriented on the first strip of material 40*a* and/or 40*b* such that the first magnet 30*a* is located between the recess 16*a* and a free end 44 of the first strip of material 40*a* and/or 40*b*. The second closure portion 110 comprises a second strip of material 42*a* and/or 42*b* to which the second body 22*a* is attached, and the second body 22*a* is oriented on the second strip of material 42*a* and/or 42*b* such that the hook 26*a* is located between the second magnet 32*a* and a free end 46 of the second strip of material 42*a* and/or 42*b*. The end 41*a* of the first strip of material 40*a* and/or 40*b* that is opposite the free end 44 thereof is configured to be connected to a first portion of a garment. The end 43*a* of the second strip of material 42*a* and/or 42*b* that is opposite the free end 46 thereof is configured to be connected to a second portion of the garment. The first and second portions of the garment are configured to be coupled to one another via the first and second closure portions 108, 110, such as by bringing the free ends 44, 46 thereof into proximity with each other.

FIGS. 4, 5, and 7-9 show how two female coupling elements 10 can be attached to the same first and second layers 40*a*, 40*b* of material. In such an example, the first and second female coupling elements 10 each include a first magnet 30 of the same polarity or polarities, intended to complement the polarity or polarities of the second magnet 32 of the male coupling element 11. The first female coupling element 10 is positioned at a first location on the first closure portion 108 and the second female coupling element is positioned on the first closure portion 108 at a second location spaced from the first female coupling element 10. This allows for the band size of the garment to which the closure portions are attached to be adjusted, as the male coupling element 11 can be attached to either of the female coupling elements 10.

The closure portions 108, 110 can be used on the ends of a garment such as the bra 100 shown in FIG. 1. For example, the closure portions 108, 110 can be used on the ends of the wings 106 of the bra. Alternatively, the closure portions 108, 110 can be used to form a front closure between the cups 102 of the bra 100. In still other examples, mating closure portions 108, 110 can be used on each side of a bra at the underarms. Moreover, the closure portions 108, 110 can be used to connect the shoulder straps 104 and cups 102 at front strap converters 111 of the bra 100. Further, mating closure portions 108, 110 can be provided on both sides of a pair of panties (FIG. 11), such that a user can connect the front and back portions of the panties at the sides of the panty or at the front of the hips. In any of these embodiments, the male and female coupling elements 11, 10 can be provided in columns such that, for example, two male coupling elements 11 attach to two female coupling elements 10 simultaneously to fasten the two ends of the garment together.

Figure 10:
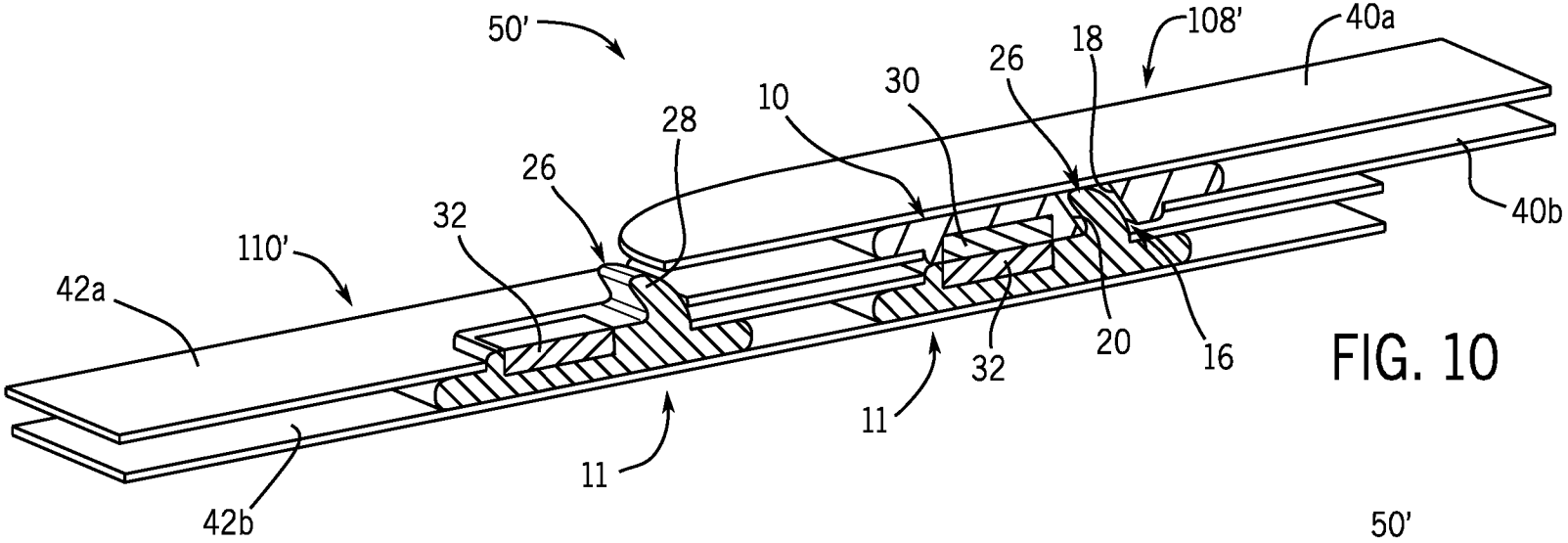
FIG. 10 illustrates another closure comprising the male and female coupling elements disclosed herein.
Figure 11:
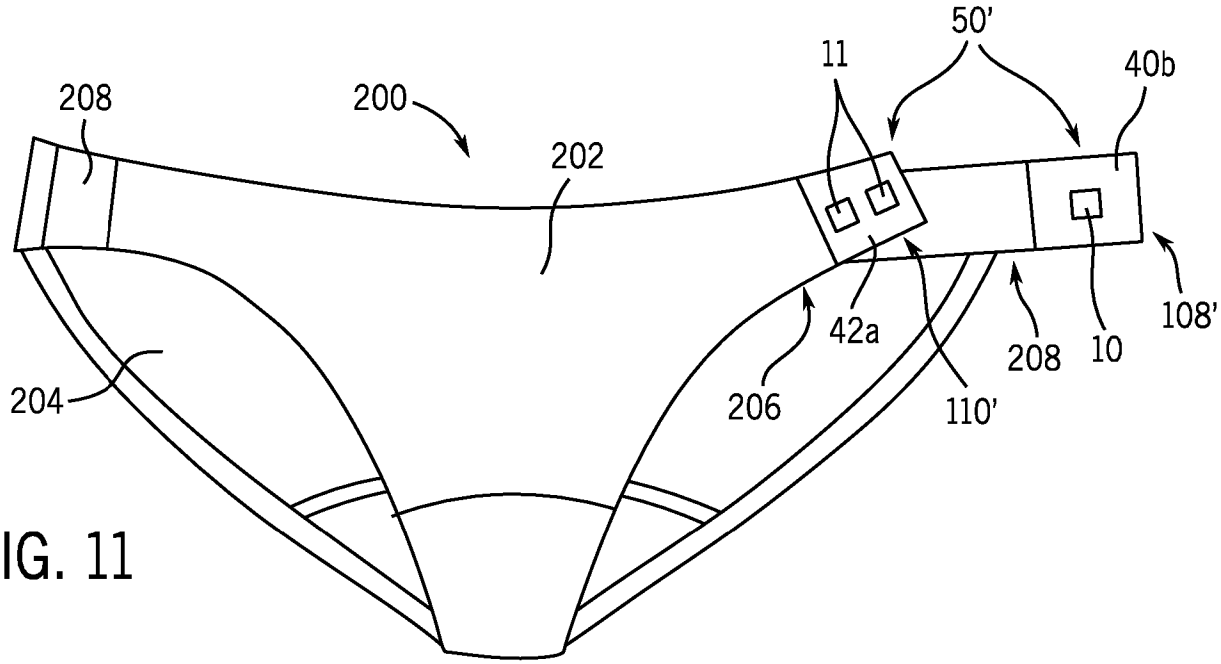
FIG. 11 illustrates a panty comprising the closure of FIG. 10.

FIG. 10 shows a closure 50' in which two male coupling elements 11 are provided on a single closure portion 110' and a single female coupling element 10 is provided on a single closure portion 108'. The components of each of the male coupling elements 11 and the female coupling element 10 are the same as those described hereinabove with respect to FIGS. 2-8 and will not be further described herein. Such a closure 50' can be used, for example, on a garment 200 such as a panty as shown in FIG. 11. The panty 200 has a front portion 202 having two front flaps 206 and a rear portion 204 having two rear flaps 208. Each pair of front and rear flaps 206, 208 is coupled together by way of the closure 50' shown in FIG. 10. The front flaps 206 (only one of which is shown) have the closure portion 110' with male coupling elements 11 thereupon. The rear flaps 208 have the closure portion 108' with female coupling element 10 thereupon. The female coupling element 10 can be connected to either one of the male coupling elements 11 to couple the front and rear flaps 206, 208 together. Such connection is made according to the principles described hereinabove with respect to FIGS. 7 and 8. The present inventors have discovered that this arrangement of male and female coupling elements makes an adaptive panty the easiest to use. In another example, a panty has one side at which the front portion 202 and the rear portion 204 are permanently connected, and the front and rear flaps 206, 208 with the respective closure portions 108', 110' are provided on the other side of the panty.

Thus, FIG. 10 shows a closure 50' for a garment, the closure 50' comprising a first closure portion 108' comprising a female coupling element 10 and a second closure portion 110' comprising a first male coupling element 11 and a second male coupling element 11. The closure 50' includes a first magnet 30 having a first polarity, a second magnet 32 having a second polarity, and a third magnet 32 having the second polarity. The female coupling element 10 comprises the first magnet 30 and a recess 16 having a sloped end 18 (see also FIG. 2). The first male coupling element 11 comprises the second magnet 32 and a first hook 26 having a first sloped arm 28. The second male coupling element 11 comprises the third magnet 32 and a second hook 26 having a second sloped arm 28. The first male coupling element 11 is positioned at a first location on the second closure portion 110' and the second male coupling element 11 is positioned at a second location on the second closure portion 110' that is spaced from the first location. The second and third magnets 32 of the respective first and second male coupling elements 11 are magnetically attracted to the first magnet 30 of the female coupling element 10. One of the first and second sloped arms 28 of a respective one of the first and second hooks 26 is configured to engage with the sloped end 18 of the recess 16 so as to couple the first and second closure portions 108', 110' together.

Each of the male and female coupling elements comprises a central body 12, 22 and an outer flange 14, 24 about the central body 12, 22. The closure 50' further comprises first and second layers 40*a*, 40*b* of material, wherein the first and second layers 40*a*, 40*b* of material are sealed around the outer flange 14 of the female coupling element 10 and are configured to be attached to a garment 200. The closure 50' further comprises third and fourth layers 42*a*, 42*b* of material, wherein the third and fourth layers 42*a*, 42*b* of material are sealed around the outer flanges 24 of the first and second male coupling elements 11 and are configured to be attached to the garment 200. As shown in FIG. 11, the garment 200 comprises a front portion 202, a rear portion 204, and the closure 50'. The first and second layers 40*a*, 40*b* of material are attached to a rear flap 208 of the rear portion 204, and the third and fourth layers 42*a*, 42*b* of material are attached to a front flap 206 of the front portion 202. The first and second closure portions 108', 110' can be coupled together to join the front and rear flaps 206, 208 of the garment 200 together. In another example, the closure 50' of FIG. 10 can be used on a bra 100 such as that shown in FIG. 1. In still another example, the closure 50 of FIGS. 7 and 8 can be used on the panty 200 of FIG. 11.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A magnetic hook-type closure for a garment comprising:

a male coupling element;

a female coupling element;

first and second layers of material;

a first magnet having a first polarity; and a second magnet having a second polarity;

wherein the male coupling element comprises the first magnet and a hook, the hook having a sloped arm;

wherein the female coupling element comprises the second magnet and a recess, the recess having a sloped end;

wherein the first magnet and the second magnet are configured to pull the male coupling element and the female coupling element towards one another;

wherein the sloped arm of the hook is configured to engage with the sloped end of the recess to guide the male coupling element into engagement with the female coupling element;

wherein each of the male and female coupling elements comprises a central body and an outer flange about the central body; and wherein the first and second layers of material are sealed around the outer flange of the female coupling element and attached to a first end of a garment.

2. The closure of claim 1, wherein one of the first and second layers of material has an opening configured to receive the central body of the female coupling element.

3. The closure of claim 1, further comprising third and fourth layers of material, wherein the third and fourth layers of material are sealed around the outer flange of the male coupling element and attached to a second end of the garment.

4. The closure of claim 3, wherein one of the third and fourth layers of material has an opening configured to receive the central body of the male coupling element.

5. The closure of claim 1, wherein each of the central bodies of the male and female coupling elements comprises a depression configured to hold the first or second magnet, respectively, such that an outer surface of the first or second magnet lies flush with an outer surface of the respective central body.

6. The closure of claim 1, wherein the female coupling element further comprises a lip at an end of the recess opposite the sloped end, the lip being configured to engage the hook of the male coupling element.

7. The closure of claim 6, wherein the lip is sloped parallel to the sloped end of the recess.

8. A closure for a garment, the closure comprising:

a first closure portion comprising a first body, a first magnet situated within the first body, and a recess formed in the first body adjacent the first magnet; and a second closure portion comprising a second body, a second magnet situated within the second body, and a hook protruding from the second body adjacent the second magnet;

wherein the recess extends from a first opening at a first surface of the first body toward a second opening at an opposite second surface of the first body, and the recess is angled such that the first opening is located further from the first magnet than the second opening with respect to a longitudinal direction of the first closure portion;

wherein the hook extends from a first end at a first surface of the second body toward a free second end, and the hook is curved from the first end to the second end toward the second magnet;

wherein the first and second closure portions are configured such that attraction between the first and second magnets aligns the first and second magnets with one another and simultaneously causes the hook to be received within the recess;

wherein the first closure portion comprises a first strip of material to which the first body is attached, and the first body is oriented on the first strip of material such that the first magnet is located between the recess and a free end of the first strip of material; and wherein the second closure portion comprises a second strip of material to which the second body is attached, and the second body is oriented on the second strip of material such that the hook is located between the second magnet and a free end of the second strip of material.

9. The closure of claim 8, wherein an end of the first strip of material that is opposite the free end thereof is configured to be connected to a first portion of a garment;

wherein an end of the second strip of material that is opposite the free end thereof is configured to be connected to a second portion of the garment; and wherein the first and second portions of the garment are configured to be coupled to one another via the first and second closure portions.

10. The closure of claim 8, wherein at least one of the first and second bodies comprises a depression configured to hold the respective first or second magnet such that an outer surface of the respective first or second magnet lies flush with an outer surface of the at least one of the first and second bodies.

11. The closure of claim 8, wherein the recess forms a lip configured to engage the hook.

12. A closure for a garment, the closure comprising:

a first closure portion comprising a female coupling element;

a second closure portion comprising a first male coupling element and a second male coupling element;

a first magnet having a first polarity;

a second magnet having a second polarity; and a third magnet having the second polarity;

wherein the female coupling element comprises the first magnet and a recess, the recess having a sloped end;

wherein the first male coupling element comprises the second magnet and a first hook, the first hook having a first sloped arm;

wherein the second male coupling element comprises the third magnet and a second hook, the second hook having a second sloped arm;

wherein the first male coupling element is positioned at a first location on the second closure portion and wherein the second male coupling element is positioned at a second location on the second closure portion that is spaced from the first location;

wherein the second magnet of the first male coupling element and the third magnet of the second male coupling element are magnetically attracted to the first magnet of the female coupling element; and wherein one of the first sloped arm of the first hook and the second sloped arm of the second hook is configured to engage with the sloped end of the recess so as to couple the first and second closure portions together.

13. The closure of claim 12, wherein each of the male and female coupling elements comprises a central body and an outer flange about the central body.

14. The closure of claim 13, further comprising first and second layers of material, wherein the first and second layers of material are sealed around the outer flange of the female coupling element and are configured to be attached to a garment.

15. The closure of claim 14, further comprising third and fourth layers of material, wherein the third and fourth layers of material are sealed around the outer flanges of the first and second male coupling elements and are configured to be attached to the garment.

16. A garment comprising a front portion, a rear portion, and the closure of claim 15, wherein the first and second layers of material are attached to a rear flap of the rear portion of the garment, and the third and fourth layers of material are attached to a front flap of the front portion of the garment.

* * * * *